US011324259B2

(12) United States Patent
Courbat et al.

(10) Patent No.: US 11,324,259 B2
(45) Date of Patent: May 10, 2022

(54) AEROSOL GENERATING SYSTEM WITH NON-CIRCULAR INDUCTOR COIL

(71) Applicant: Philip Morris Products S.A., Neuchatel (CH)

(72) Inventors: Jerome Christian Courbat, Colombier (CH); Oleg Mironov, Cudrefin (CH); Tony Reevell, London (GB); Enrico Stura, Palezieux Village (CH)

(73) Assignee: Philip Morris Products S.A., Neuchatel (CH)

( * ) Notice: Subject to any disclaimer, the term of this patent is extended or adjusted under 35 U.S.C. 154(b) by 118 days.

(21) Appl. No.: 16/637,510

(22) PCT Filed: Aug. 8, 2018

(86) PCT No.: PCT/EP2018/071544
§ 371 (c)(1),
(2) Date: Feb. 7, 2020

(87) PCT Pub. No.: WO2019/030301
PCT Pub. Date: Feb. 14, 2019

(65) Prior Publication Data

US 2020/0214350 A1 Jul. 9, 2020

(30) Foreign Application Priority Data

Aug. 9, 2017 (EP) ..... 17185590

(51) Int. Cl.
*A24F 13/00* (2006.01)
*A24F 40/465* (2020.01)
(Continued)

(52) U.S. Cl.
CPC ..... *A24F 40/465* (2020.01); *A24F 40/57* (2020.01); *H05B 6/108* (2013.01); *A24F 40/20* (2020.01)

(58) Field of Classification Search
CPC ..... A24F 47/00; A24F 40/465
(Continued)

(56) References Cited

U.S. PATENT DOCUMENTS

2014/0366900 A1 12/2014 Plojoux et al.
2015/0282525 A1 10/2015 Plojoux et al.
(Continued)

FOREIGN PATENT DOCUMENTS

CN 204949521 U 1/2016
EP 2 609 821 A1 7/2013
(Continued)

OTHER PUBLICATIONS

International Search Report and Written Opinion dated Oct. 15, 2018 in PCT/EP2018/071544 filed on Aug. 8, 2018.
(Continued)

*Primary Examiner* — Phuong K Dinh
(74) *Attorney, Agent, or Firm* — Oblon, McClelland, Maier & Neustadt, L.L.P

(57) ABSTRACT

An aerosol-generating device is provided, including: a housing having a chamber configured to receive at least a portion of an aerosol-generating article; an inductor coil disposed around at least a portion of the chamber; a plurality of elongate susceptor elements projecting into the chamber and spaced apart from each other, the susceptor elements each extending substantially parallel to a magnetic axis of the inductor coil; and a power supply and a controller connected to the inductor coil and configured to provide an alternating electric current to the inductor coil such that the inductor coil generates an alternating magnetic field to heat the susceptor elements and thereby heat at least a portion of the article received in the chamber, the inductor coil being helical and having a non-circular cross-sectional shape. An aerosol-
(Continued)

generating system including the device, the article, and the susceptor elements, is also provided.

15 Claims, 9 Drawing Sheets

(51) Int. Cl.
*A24F 40/57* (2020.01)
*H05B 6/10* (2006.01)
*A24F 40/20* (2020.01)

(58) Field of Classification Search
USPC ..... 131/329
See application file for complete search history.

(56) References Cited

U.S. PATENT DOCUMENTS

| | | | | |
|---|---|---|---|---|
| 2016/0309782 | A1* | 10/2016 | Malgat | A24D 1/20 |
| 2017/0055580 | A1 | 3/2017 | Blandino et al. | |
| 2017/0079326 | A1 | 3/2017 | Mironov | |
| 2017/0188634 | A1 | 7/2017 | Plojoux et al. | |
| 2017/0360102 | A1* | 12/2017 | Li | H05B 6/44 |
| 2018/0184713 | A1* | 7/2018 | Mironov | A24F 40/465 |
| 2021/0145067 | A1* | 5/2021 | Bleloch | H05B 6/06 |

FOREIGN PATENT DOCUMENTS

| | | | |
|---|---|---|---|
| RU | 2 600 912 | C1 | 10/2016 |
| WO | WO 95/27411 | A1 | 10/1995 |
| WO | 2013/098411 | A1 | 7/2013 |
| WO | WO 2014/048745 | A1 | 4/2014 |
| WO | WO 2015/131058 | A1 | 9/2015 |
| WO | 2015/155289 | A1 | 10/2015 |
| WO | WO 2015/175568 | A1 | 11/2015 |
| WO | WO 2015/176898 | A1 | 11/2015 |
| WO | WO 2015/177043 | A1 | 11/2015 |
| WO | WO 2015/177044 | A1 | 11/2015 |
| WO | WO 2015/177045 | A1 | 11/2015 |
| WO | WO 2015/177046 | A1 | 11/2015 |
| WO | WO 2015/177247 | A1 | 11/2015 |
| WO | WO 2015/177252 | A1 | 11/2015 |
| WO | WO 2015/177253 | A1 | 11/2015 |
| WO | WO 2015/177254 | A1 | 11/2015 |
| WO | WO 2015/177257 | A1 | 11/2015 |
| WO | WO 2015/177263 | A1 | 11/2015 |
| WO | WO 2015/177264 | A1 | 11/2015 |
| WO | WO 2015/177265 | A1 | 11/2015 |
| WO | WO 2015/198015 | A1 | 12/2015 |
| WO | WO 2016/075436 | A1 | 5/2016 |
| WO | WO 2016/090037 | A1 | 6/2016 |
| WO | WO 2016/156500 | A1 | 10/2016 |
| WO | WO 2016/184928 | A1 | 11/2016 |
| WO | WO 2016/184929 | A1 | 11/2016 |
| WO | WO 2016/184930 | A1 | 11/2016 |
| WO | WO 2017/001818 | A1 | 1/2017 |
| WO | WO 2017/001819 | A1 | 1/2017 |
| WO | WO 2017/001820 | A1 | 1/2017 |
| WO | WO 2017/005705 | A1 | 1/2017 |
| WO | WO 2017/029268 | A1 | 2/2017 |
| WO | WO 2017/029269 | A1 | 2/2017 |
| WO | WO 2017/029270 | A1 | 2/2017 |
| WO | WO 2017/036950 | A2 | 3/2017 |
| WO | WO 2017/036951 | A1 | 3/2017 |
| WO | WO 2017/036954 | A1 | 3/2017 |
| WO | WO 2017/036955 | A2 | 3/2017 |
| WO | WO 2017/036957 | A1 | 3/2017 |
| WO | WO 2017/036958 | A2 | 3/2017 |
| WO | WO 2017/036959 | A1 | 3/2017 |
| WO | WO 2017/064487 | A1 | 4/2017 |
| WO | WO 2017/068092 | A1 | 4/2017 |
| WO | WO 2017/068095 | A1 | 4/2017 |
| WO | WO 2017/068098 | A1 | 4/2017 |
| WO | WO 2017/068099 | A1 | 4/2017 |
| WO | WO 2017/068100 | A1 | 4/2017 |
| WO | WO 2017/072144 | A1 | 5/2017 |
| WO | WO 2017/072145 | A1 | 5/2017 |
| WO | WO 2017/072148 | A1 | 5/2017 |
| WO | WO 2017/072149 | A1 | 5/2017 |
| WO | WO 2017/077503 | A1 | 5/2017 |
| WO | WO 2017/085242 | A1 | 5/2017 |

OTHER PUBLICATIONS

Combined Russian Office Action and Search Report dated Nov. 12, 2021 in corresponding Russian Patent Application No. 2020109532 (with English translation), 13 pages.

* cited by examiner

AEROSOL GENERATING SYSTEM WITH NON-CIRCULAR INDUCTOR COIL

CROSS-REFERENCE TO RELATED APPLICATIONS

This application is a U.S. national stage application of PCT/EP2018/071544, filed on Aug. 8, 2018, which is based upon and claims the benefit of priority from European patent application no. 17185590.1, filed Aug. 9, 2017, the entire contents of each of which are incorporated herein by reference.

TECHNICAL FIELD

The present invention relates to an aerosol-generating device. In particular, the invention relates to an aerosol-generating device having an inductive heater for heating an aerosol-generating article using a susceptor element. The present invention also relates to an aerosol-generating system including such an aerosol-generating device in combination with an aerosol-generating article for use with the aerosol-generating device.

DESCRIPTION OF THE RELATED ART

A number of electrically-operated aerosol-generating systems in which an aerosol-generating device having an electric heater is used to heat an aerosol-forming substrate, such as a tobacco plug, have been proposed in the art. One aim of such aerosol-generating systems is to reduce known harmful smoke constituents of the type produced by the combustion and pyrolytic degradation of tobacco in conventional cigarettes. Typically, the aerosol-generating substrate is provided as part of an aerosol-generating article which is inserted into a chamber or cavity in the aerosol-generating device. In some known systems, to heat the aerosol-forming substrate to a temperature at which it is capable of releasing volatile components that can form an aerosol, a resistive heating element such as a heating blade is inserted into or around the aerosol-forming substrate when the article is received in the aerosol-generating device. In other aerosol-generating systems, an inductive heater is used rather than a resistive heating element. The inductive heater typically comprises an inductor forming part of the aerosol-generating device and a conductive susceptor element arranged such that it is in thermal proximity to the aerosol-forming substrate. The inductor generates an alternating magnetic field to generate eddy currents and hysteresis losses in the susceptor element, causing the susceptor element to heat up, thereby heating the aerosol-forming substrate.

In known systems having an inductor and a conductive susceptor element, the susceptor element is typically fixed within the chamber of the aerosol-generating device and configured such that it extends at least partially into an aerosol-generating article received in the chamber. The susceptor element heats the aerosol-forming substrate of the aerosol-generating article from within when energised by the inductor coil. For example, the susceptor element may be arranged to penetrate the aerosol-forming substrate of the aerosol-generating article when the aerosol-generating article is received in the chamber.

It would be desirable to provide an aerosol-generating device that facilitates even heat distribution when heating an aerosol-generating article.

SUMMARY

According to a first aspect of the present invention, there is provided an aerosol-generating device a housing having a chamber sized to receive at least a portion of an aerosol-generating article; an inductor coil disposed around at least a portion of the chamber; a plurality of elongate susceptor elements projecting into the chamber and spaced apart from each other, the plurality of elongate susceptor elements each extending substantially parallel to a magnetic axis of the inductor coil; and a power supply and a controller connected to the inductor coil and configured to provide an alternating electric current to the inductor coil such that, in use, the inductor coil generates an alternating magnetic field to heat the plurality of elongate susceptor elements and thereby heat at least a portion of an aerosol-generating article received in the chamber, wherein the inductor coil is helical and has a non-circular cross-sectional shape.

According to a second aspect of the present invention, there is provided an aerosol-generating system comprising an aerosol-generating device in accordance with any of the embodiments discussed herein, and an aerosol-generating article comprising an aerosol-forming substrate and configured for use with the aerosol-generating device.

According to a third aspect of the present invention, there is provided an aerosol-generating device and an aerosol-generating article having an aerosol-foiling substrate and which is configured for use with the aerosol-generating device, wherein the aerosol-generating device comprises: a housing having a chamber sized to receive at least a portion of an aerosol-generating article; an inductor coil disposed around at least a portion of the chamber; and a power supply and a controller connected to the inductor coil, wherein the aerosol-generating system further comprises a plurality of elongate susceptor elements located in the chamber and spaced apart from each other, the plurality of elongate susceptor elements each extending substantially parallel to a magnetic axis of the inductor coil, and wherein the power supply and the controller are configured to provide an alternating electric current to the inductor coil such that, in use, the inductor coil generates an alternating magnetic field to heat the plurality of elongate susceptor elements and thereby heat at least a portion of the aerosol-generating article, wherein the inductor coil is helical and has a non-circular cross-sectional.

BRIEF DESCRIPTION OF THE DRAWINGS

The invention will be further described, by way of example only, with reference to the accompanying drawings, in which.

DETAILED DESCRIPTION

Figure 1:
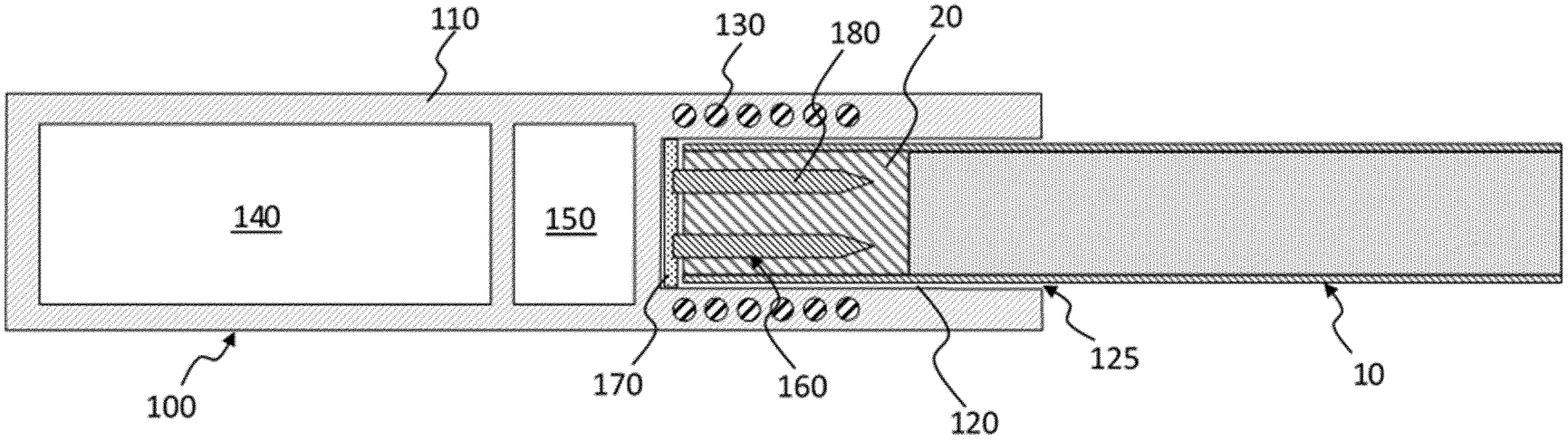
FIG. 1 is a schematic cross-sectional illustration of an aerosol-generating system in accordance with a first embodiment of the present invention.
Figure 2:
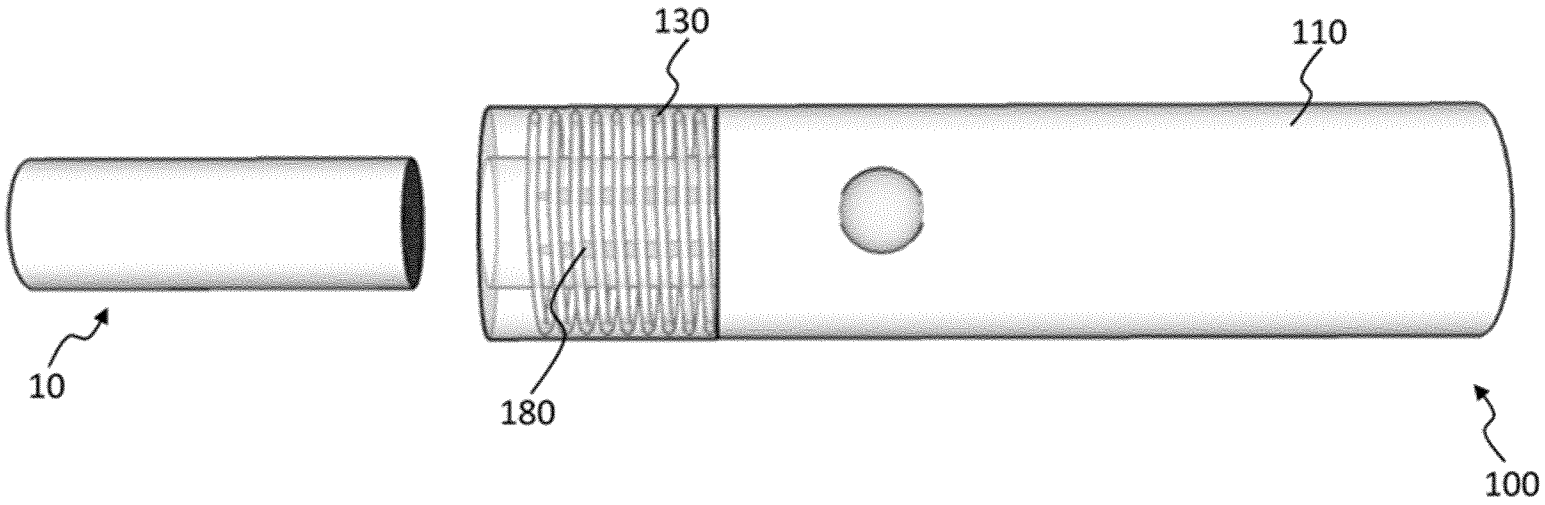
FIG. 2 is a perspective top view of the aerosol-generating system of FIG. 1, in which the aerosol-generating article is not received in the chamber and in which the inductor coil and the elongate susceptor elements are also shown.

As used herein, the term 'longitudinal' is used to describe the direction along the main axis of the aerosol-generating device, of an aerosol-generating article, or of a component of the aerosol-generating device or an aerosol-generating article, and the term 'transverse' is used to describe the direction perpendicular to the longitudinal direction. When referring to the chamber, the term 'longitudinal' refers to the direction in which an aerosol-generating article is inserted into the chamber and the term 'transverse' refers to a direction perpendicular to the direction in which an aerosol-generating article is inserted into the chamber.

Generally, the chamber will have an open end in which an aerosol-generating article is inserted, and a closed end opposite the open end. In such embodiments, the longitudinal direction is the direction extending between the open and closed ends. In certain embodiments, the longitudinal axis of the chamber is parallel with the longitudinal axis of the aerosol-generating device. For example, where the open end of the chamber is positioned at the proximal end of the aerosol-generating device. In other embodiments, the longitudinal axis of the chamber is at an angle to the longitudinal axis of the aerosol-generating device, for example transverse to the longitudinal axis of the aerosol-generating device. For example, where the open end of the chamber is positioned along one side of the aerosol-generating device such that an aerosol-generating article may be inserted into the chamber in direction which is perpendicular to the longitudinal axis of the aerosol-generating device.

As used herein, the term "proximal" refers to a user end, or mouth end of the aerosol-generating device, and the term "distal" refers to the end opposite to the proximal end. When referring to the chamber or the inductor coil, the term "proximal" refers to the region closest to the open end of the chamber and the term "distal" refers to the region closest to the closed end. The ends of the aerosol-generating device or the chamber may also be referred to in relation to the direction in which air flows through the aerosol-generating device. The proximal end may be referred to as the "downstream" end and the distal end referred to as the "upstream" end.

As used herein, the term "length" refers to the major dimension in a longitudinal direction of the aerosol-generating device, of an aerosol-generating article, or of a component of the aerosol-generating device or of an aerosol-generating article.

As used herein, the term "width" refers to the major dimension in a transverse direction of the aerosol-generating device, of an aerosol-generating article, or of a component of the aerosol-generating device or of an aerosol-generating article, at a particular location along its length. The term "thickness" refers to the dimension in a transverse direction perpendicular to the width.

As used herein, the term 'aerosol-forming substrate' relates to a substrate capable of releasing volatile compounds that can form an aerosol. Such volatile compounds may be released by heating the aerosol-forming substrate. An aerosol-forming substrate is part of an aerosol-generating article.

As used herein, the term 'aerosol-generating article' refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In the system, the aerosol-generating article and the aerosol-generating device cooperate to generate a respirable aerosol.

As used herein, the term 'elongate' refers to a component having a length which is greater than both its width and thickness, for example twice as great.

As used herein, a "susceptor element" means a conductive element that heats up when subjected to a changing magnetic field. This may be the result of eddy currents induced in the susceptor element, hysteresis losses, or both eddy currents and hysteresis losses. During use, the susceptor elements are located in thermal contact or close thermal proximity with the aerosol-forming substrate of an aerosol-generating article received in the chamber of the aerosol-generating device. In this manner, the aerosol-forming substrate is heated by the susceptor elements such that an aerosol is formed.

By providing an inductor coil which is helical and has a non-circular cross-sectional shape, the fluctuating magnetic field is concentrated in a plurality of focus regions which are spaced apart in a transverse direction of the chamber. Each of the plurality of elongate susceptor elements may be at least partially aligned with one of the plurality of focus regions. This may facilitate an increased heating effect for each of the elongate susceptor elements. This may facilitate an increased heating effect across the area of the chamber.

In aerosol-generating devices according to the present invention, a plurality of elongate susceptor elements project into the chamber and are spaced apart in a transverse direction of the chamber. Advantageously, by providing a plurality of elongate susceptor elements spaced apart in a transverse direction of the chamber, more even heating of an aerosol-generating article may be achieved across the width of the aerosol-generating article. More even heat distribution may result in more consistent aerosol properties and more effective use of the aerosol-forming substrate. By heating the aerosol-forming substrate more effectively, the power required to heat the aerosol-forming substrate may be reduced. This may facilitate efficient operation of the aerosol-generating device. This may allow battery size to be reduced or may allow battery life to be increased for a given battery size. This may facilitate a more compact arrangement.

The plurality of elongate susceptor elements may be spaced apart from each other in a transverse direction of the chamber. The plurality of elongate susceptor elements may be spaced apart from each other along a plane that is orthogonal to the longitudinal axis of the chamber.

By providing more even heating across the width of the aerosol-generating article, the width or thickness, or width and thickness, of each individual susceptor element may be reduced. This may advantageously reduce the force required to insert an aerosol-generating article into the chamber. Reducing the width or thickness, or width and thickness, of each individual susceptor element may reduce the amount of aerosol-forming substrate which is displaced during insertion, thereby reducing or eliminating the need to cleaning the chamber after use.

Additionally, in embodiments in which the chamber of the aerosol-generating device and the aerosol-generating article have circular cross-sections, the claimed arrangement of elongate susceptor elements may reduce or prevent inadvertent rotation of the aerosol-generating article within the chamber which may otherwise result in damage to the heater.

Using inductive heating has the advantage that the heating element, in this case the susceptor elements, need not be electrically joined to any other components, eliminating the need for solder or other bonding elements for the heating element. Furthermore, the inductor coil is provided as part of the aerosol-generating device making it possible to construct an aerosol-generating article that is simple, inexpensive and robust. Aerosol-generating articles are typically disposable and produced in much larger numbers that the aerosol-generating devices with which they operate. Accordingly, reducing the cost of the aerosol-generating articles, even if it requires a more expensive aerosol-generating device, can lead to significant cost savings for both manufacturers and consumers.

In addition, the use of inductive heating rather than a resistive coil may provide improved energy conversion because of power losses associated with a resistive coil, in particular losses due to contact resistance at connections between the resistive coil and the power supply.

In aerosol-generating devices according to the present invention, the inductor coil has a non-circular cross-sectional shape such that the fluctuating magnetic field is concentrated in a plurality of focus regions which are spaced apart in a transverse direction of the chamber. This allows each of the plurality of elongate susceptor elements to be at least partially aligned with one of the plurality of focus regions. This may facilitate increased heating effect across the area of the chamber. This may facilitate efficient operation of the aerosol-generating device. This differs from a circular helical coil in which the magnetic field is concentrated in a single, central focus region.

The plurality of elongate susceptor elements extend substantially parallel to the magnetic axis of the inductor coil. The may allow for more even heating of the susceptor elements by the inductor coil. As used, herein, the term "substantially parallel" means within plus or minus 10 degrees, preferably within plus or minus 5 degrees.

The plurality of elongate susceptor elements extend in the longitudinal direction of the chamber. That is, preferably, at least a portion of each susceptor element extends substantially parallel with the longitudinal axis of the chamber. Advantageously, this facilitates insertion of at least a portion of the elongate susceptor elements into an aerosol-generating article when the aerosol-generating article is inserted into the chamber. The plurality of elongate susceptor elements may be arranged such that their longitudinal axes are at an angle to, that is, non-parallel with, the longitudinal axis of the chamber. One or more of the plurality of elongate susceptor elements may be substantially parallel with the longitudinal axis of the chamber.

In preferred embodiments, the plurality of elongate susceptor elements are substantially parallel with the longitudinal axis of the chamber. In this manner, the susceptor elements may be more easily inserted into the aerosol-generating article when the aerosol-generating article is inserted into the chamber.

The magnetic axis of the inductor coil may be at an angle to, that is, non-parallel with, the longitudinal axis of the chamber. In preferred embodiments, the magnetic axis of the inductor coil is substantially parallel with the longitudinal axis of the chamber. This may facilitate a more compact arrangement. Preferably, at least a portion of each elongate susceptor element is substantially parallel with the magnetic axis of the inductor coil. This may facilitate even heating of the elongate susceptor elements by the inductor coil. In particularly preferred embodiments, the plurality of elongate susceptor elements are substantially parallel with each other, with the magnetic axis of the inductor coil, and with the longitudinal axis of the chamber.

One or more of the plurality of elongate susceptor elements may be at least partially coincident with the longitudinal axis of the chamber. For example, one or more of the plurality of elongate susceptor elements may be at an angle to the longitudinal axis of the chamber and may pass through the longitudinal axis of the chamber at a position along its length. Alternatively, or in addition, one of the plurality of elongate susceptor elements may be parallel with the longitudinal axis of the chamber and positioned centrally within the chamber such that it extends along the longitudinal axis of the chamber.

In preferred embodiments, the plurality of elongate susceptor elements are each spaced apart from the longitudinal axis of the chamber. In this manner, the plurality of elongate susceptor elements are spaced apart from each other and from the longitudinal axis of the chamber. This may facilitate even heat distribution across the chamber and, consequently, across the width of an aerosol-generating article received in the chamber.

Where the plurality of elongate susceptor elements are spaced apart from the longitudinal axis of the chamber, the distance of one or more of the plurality of elongate susceptor elements from the longitudinal axis may differ from that of one or more of the other elongate susceptor elements. This may allow the aerosol-generating device to evenly heat a non-symmetrical aerosol-forming substrate.

In preferred embodiments, the plurality of elongate susceptor elements are equidistant from the longitudinal axis of the chamber. That is, the distance of each of the plurality of elongate susceptor elements from the longitudinal axis is the same at a given position along the length of each elongate susceptor element. This may facilitate even heating of a symmetrical aerosol-forming substrate by distributing heat evenly across the width of the chamber. It may also avoid the need for an aerosol-generating article to be inserted into the chamber with a particular orientation, as may be the case with a non-symmetrical aerosol-forming substrate and differing distances of the plurality of elongate susceptor elements from the longitudinal axis.

The plurality of elongate susceptor elements may comprise any suitable number of susceptor elements projecting into the chamber. The number of susceptor elements may be selected, for example, based on the size of the chamber, the size, geometry and composition of the susceptor elements, and the size and composition of the aerosol-forming substrate with which the aerosol-generating device is intended for use. For example, the plurality of elongate susceptor elements may consist of two elongate susceptor elements which are spaced apart in a transverse direction of the chamber.

In certain embodiments, the plurality of elongate susceptor elements comprises three or more elongate susceptor elements. For example, the plurality of elongate susceptor elements may comprise three, four, five, six, seven, eight, nine, ten or more elongate susceptor elements. In such embodiments, the plurality of elongate susceptor elements may be spaced apart from each other in a single transverse direction such that they extend substantially along the same plane. This may allow for more even heating of an aerosol-forming substrate in comparison to an arrangement consisting of two elongate susceptor elements.

The plurality of elongate susceptor elements may be spaced apart in a first transverse direction of the chamber and in a second traverse direction of the chamber which is perpendicular the first transverse direction. In this manner, the plurality of elongate susceptor elements are spaced apart across an area. This may result in particularly even heating of the aerosol-forming substrate of an aerosol-generating article received in the chamber.

Where the plurality of elongate susceptor elements comprises three or more elongate susceptor elements, the three or more elongate susceptor elements may be spaced apart from each other in an irregular pattern with uneven spacing between one or more pairs of adjacent susceptor elements. The plurality of elongate susceptor elements may be arranged in a formation in which each susceptor element is positioned at the vertex of a polygon having sides of unequal length, having unequal corner angles, or having sides of unequal length and unequal corner angles. For example, the plurality of elongate susceptor elements may consist of four elongate susceptor elements positioned at the vertices of a rectangle, a trapezium, a diamond, a kite shape, positioned on a single circle, or in another other irregular formation.

In preferred embodiments, the plurality of elongate susceptor elements may be arranged in a regular pattern within the non-circular cross-sectional shape of the inductor coil. As used herein, the term "regular pattern" is used to denote a pattern comprising a consistently spaced array of elongate susceptor elements. For example, the elongate susceptor elements may be provided in a regular striped pattern, a regular checked or square pattern, a regular brick pattern, a regular honeycomb or hexagonal pattern, or any other regular geometric pattern. The arrangement of the plurality of elongate susceptor elements may be chosen based on the cross-sectional shape of the inductor coil, or vice versa.

The inductor coil may have any suitable non-circular cross-sectional shape. For example, the inductor coil may have an elliptical, triangular, square, rectangular, trapezoidal, rhomboidal, diamond, kite, pentagonal, hexagonal, heptagonal, octagonal, nonagonal, decagonal, or any other polygonal cross-sectional shape. The inductor coil may have a regular polygonal cross-sectional shape. For example, an equilateral triangular, square, regular pentagonal, regular hexagonal, regular heptagonal, regular octagonal, regular nonagonal, or regular decagonal cross-sectional shape.

The plurality of elongate susceptor elements may comprise three or more elongate susceptor elements arranged in a formation in which each susceptor element is positioned at the vertex of a regular polygon. That is, at the vertex of a polygon that is equiangular and equilateral. This may facilitate consistent heating across the area of the chamber. For example, where the plurality of elongate susceptor elements comprises three elongate susceptor elements, these may be arranged in a triangular formation, such as an equilateral triangular formation. Where the plurality of elongate susceptor elements comprises four elongate susceptor elements, these may be arranged in a square formation.

The non-circular cross-sectional shape of the inductor coil preferably has rounded corners. For example, where the inductor coil has a triangular cross-sectional shape, the vertices of the triangle are preferably not defined by sharp angles but by rounded vertices. This may reduce areas of local resistance increase.

Advantageously, the inductor coil has a triangular cross-sectional shape and the plurality of elongate susceptor elements comprises three elongate susceptor elements arranged in a triangle within and corresponding to the triangular cross-sectional shape of the inductor coil. Each of the three elongate susceptor elements may be positioned at a different vertex of the triangle. Each of the elongate susceptor elements is at least partially aligned with one of the plurality of focus regions.

In certain embodiments, the inductor coil has an equilateral triangular cross-sectional shape and the plurality of elongate susceptor elements comprises three elongate susceptor elements arranged in an equilateral triangle within and corresponding to the equilateral triangular cross-sectional shape of the inductor coil, wherein each of the three elongate susceptor elements is be positioned at a different vertex of the triangle and is at least partially aligned with one of the plurality of focus regions.

Advantageously, the inductor coil has a square cross-sectional shape, and wherein plurality of elongate susceptor elements comprises four elongate susceptor elements arranged in a square within and corresponding to the square cross-sectional shape of the inductor coil, wherein each of the four elongate susceptor elements is positioned at a different corner of the square and is at least partially aligned with one of the plurality of focus regions.

Advantageously, the inductor coil has an elliptical cross-sectional shape, and the plurality of elongate susceptor elements comprises two elongate susceptor elements each of which is at least partially aligned with one of the plurality of focus regions of the inductor coil.

The two elongate susceptor elements may be positioned along the major axis of the elliptical cross-sectional shape of the inductor coil.

The two elongate susceptor elements may each be positioned at a focus of the elliptical cross-sectional shape of the inductor coil.

The plurality of elongate susceptor elements project into the chamber.

The plurality of elongate susceptor elements may each comprise a free end projecting into the chamber. The free end may be configured for insertion into an aerosol-generating article when the aerosol-generating article is inserted into the chamber.

Advantageously, the plurality of elongate susceptor elements each comprises a tapered free end. That is, the cross-sectional area of the elongate susceptor element decreases in a direction towards its free end. Advantageously, a tapered free end facilitates insertion of the elongate susceptor element into an aerosol-generating article. Advantageously, a tapered free end may reduce the amount of aerosol-forming substrate displaced by the elongate susceptor element during insertion of an aerosol-generating article into the chamber. This may reduce the amount of cleaning required.

One or more of the susceptor elements may be fixed to the aerosol-generating device. One or more of the susceptor elements may be removable from the aerosol-generating device. This may allow one or more of the susceptor elements to be replaced independently of the device, or to be removed for cleaning. For example, one or more susceptor elements may be removable as one or more discrete components, or as part of a removable susceptor assembly. The plurality of susceptor elements within the chamber may all be fixed within the chamber.

Advantageously, the plurality of elongate susceptor elements are removably attached to the housing. For example, the elongate susceptor elements may be removably attached to the housing within the chamber. Advantageously, this facilitates cleaning of the susceptor elements, replacement of the susceptor elements, or both. It may also facilitate cleaning of the chamber. It may allow the susceptor elements to be selectively replaced by a user according to the aerosol-generating article with which the susceptor elements will be used. For example, certain susceptor elements may be particularly suited, or tuned, for use with a particular type of aerosol-generating article, or with an aerosol-generating article having a particular arrangement or type of aerosol-forming substrate. This may allow the performance of the aerosol-generating device with which the susceptor element is used to be optimised based on the type of aerosol-generating article.

The elongate susceptor elements may be removably attached to the aerosol-generating device by any suitable mechanism. For example, by a threaded connection, by frictional engagement, or by a mechanical connection such as a bayonet, a clip, or equivalent, mechanism.

The plurality of elongate susceptor elements may be attached to the housing directly or via one or more intermediate components. This may be the case for removable coupling as well as for fixed attachment. In certain embodiments, the plurality of elongate susceptor elements may be attached to a base portion which is removably attached to the device housing. The plurality of elongate susceptor elements may be removably coupled to the base portion, or fixed to the base portion.

The plurality of elongate susceptor elements may extend along only part of the length of the chamber. The plurality elongate susceptor elements may extend along substantially the entire length of the chamber. The elongate susceptor element may extend beyond the chamber to protrude from the housing. The elongate susceptor elements may be removably attached to the aerosol-generating device and may extend beyond the chamber to protrude from the housing. This may facilitate ease of removal of the susceptor elements by a user.

The aerosol-generating device comprises a plurality of elongate susceptor elements projecting into the chamber. The aerosol-generating device may further comprise non-elongate susceptor elements within the chamber. The aerosol-generating device may further comprise one or more external susceptor elements. External susceptor elements are configured to remain outside of an aerosol-generating article received in the chamber. For example, the one or more external susceptor elements may extend at least partially around the circumference of the aerosol-generating article when the aerosol-generating article is received in the chamber.

The susceptor elements may be formed from any material that can be inductively heated to a temperature sufficient to aerosolise an aerosol-forming substrate. Suitable materials for the susceptor elements include graphite, molybdenum, silicon carbide, stainless steels, niobium, aluminium, nickel, nickel containing compounds, titanium, and composites of metallic materials. Preferred susceptor elements comprise a metal or carbon. Advantageously each susceptor element comprises or consists of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor preferably comprises more than 5 percent, preferably more than 20 percent, more preferably more than 50 percent or more than 90 percent of ferromagnetic or paramagnetic materials. Preferred susceptor elements may be heated to a temperature in excess of 250 degrees Celsius.

One or more of the susceptor elements may be formed from a single material layer. The single material layer may be a steel layer.

The susceptor elements may comprise a non-metallic core with a metal layer disposed on the non-metallic core. For example, one or more of the susceptor elements may comprise metallic tracks formed on an outer surface of a ceramic core or substrate. A susceptor element may have a protective external layer, for example a protective ceramic layer or protective glass layer. The protective external layer may encapsulate the susceptor element. A susceptor element may comprise a protective coating formed by a glass, a ceramic, or an inert metal, formed over a core of susceptor material.

One or more of the susceptor elements may be formed from a layer of austenitic steel. One or more layers of stainless steel may be arranged on the layer of austenitic steel. For example, one or more of the susceptor elements may be formed from a layer of austenitic steel having a layer of stainless steel on each of its upper and lower surfaces.

The elongate susceptor elements may each comprise a first susceptor material and a second susceptor material. The first susceptor material may be disposed in intimate physical contact with the second susceptor material. The first and second susceptor materials may be in intimate contact to form a unitary susceptor. In certain embodiments, the first susceptor material is stainless steel and the second susceptor material is nickel. One or more of the susceptor elements may have a two layer construction. Such susceptor elements may be formed from a stainless steel layer and a nickel layer.

Intimate contact between the first susceptor material and the second susceptor material may be made by any suitable means. For example, the second susceptor material may be plated, deposited, coated, clad or welded onto the first susceptor material. Preferred methods include electroplating, galvanic plating and cladding.

The second susceptor material may have a Curie temperature that is lower than 500° C. The first susceptor material may be primarily used to heat the susceptor when the susceptor is placed in an alternating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys. The Curie temperature of the second susceptor material may preferably be selected to be lower than 400° C., preferably lower than 380° C., or lower than 360° C. It is preferable that the second susceptor material is a magnetic material selected to have a Curie temperature that is substantially the same as a desired maximum heating temperature. That is, it is preferable that the Curie temperature of the second susceptor material is approximately the same as the temperature that the susceptor should be heated to in order to generate an aerosol from the aerosol-forming substrate. The Curie temperature of the second susceptor material may, for example, be within the range of 200° C. to 400° C., or between 250° C. and 360° C. In some embodiments it may be preferred that the first susceptor material is in the form of an elongate strip having a width of between 3 mm and 6 mm and a thickness of between 10 micrometres and 200 micrometres, and that the second susceptor material is in the form of discrete patches that are plated, deposited, or welded onto the first susceptor material. For example, the first susceptor material may be an elongate strip of grade 430 stainless steel or an elongate strip of aluminium and the second elongate material may be in the form of patches of nickel having a thickness of between 5 micrometres and 30 micrometres deposited at intervals along the elongate strip of the first susceptor material. Patches of the second susceptor material may have a width of between 0.5 mm and the thickness of the elongate strip. For example the width may be between 1 mm and 4 mm, or between 2 mm and 3 mm. Patches of the second susceptor material may have a length between 0.5 mm and about 10 mm, preferably between 1 mm and 4 mm, or between 2 mm and 3 mm.

In some embodiments it may be preferred that the first susceptor material and the second susceptor material are co-laminated in the form of an elongate strip having a width of between 3 mm and 6 mm and a thickness of between 10 micrometres and 200 micrometres. Preferably, the first susceptor material has a greater thickness than the second susceptor material. The co-lamination may be formed by any suitable means. For example, a strip of the first susceptor material may be welded or diffusion bonded to a strip of the second susceptor material. Alternatively, a layer of the second susceptor material may be deposited or plated onto a strip of the first susceptor material.

In some embodiments it may be preferred that each elongate susceptor has a width of between 3 mm and 6 mm and a thickness of between 10 micrometres and 200 micrometres, the susceptor comprising a core of the first susceptor material encapsulated by the second susceptor material. Thus, the susceptors may each comprise a strip of the first susceptor material that has been coated or clad by the second susceptor material. As an example, the susceptor may comprise a strip of 430 grade stainless steel having a length of 12 mm, a width of 4 mm and a thickness of between 10 micrometres and 50 micrometres, for example 25 micrometres. The grade 430 stainless steel may be coated with a layer of nickel of between 5 micrometres and 15 micrometres, for example 10 micrometres.

One or more of the elongate susceptor elements may comprise a first susceptor material, a second susceptor material and a protective layer. The first susceptor material may be disposed in intimate physical contact with the second susceptor material. The protective layer may be disposed in intimate physical contact with one or both of the first susceptor material the second susceptor material. The first and second susceptor materials and the protective layer may be in intimate contact to form a unitary susceptor. The protective layer may be a layer of austenitic steel. In certain embodiments, one or more of the elongate susceptor elements comprises a layer of steel, a layer of nickel, and a protective layer of austenitic steel. The protective layer of austenitic steel may be applied to the nickel layer. This may help to protect the nickel layer from detrimental environmental effects, such as oxidation, corrosion, and diffusion.

The plurality of elongate susceptor elements may be formed from the same materials. Alternatively, one or more of the elongate susceptor elements may comprise susceptor material or materials having different susceptor characteristics to at least one of the other susceptor elements. This may facilitate fine-tuning of heat distribution. This may also facilitate sequential heating of the susceptor elements. For example, by forming the susceptor elements from materials for which optimal heating occurs at different frequencies of alternating current.

The elongate susceptor elements may have any suitable cross-section. For example, the elongate susceptor elements may have a square, oval, rectangular, triangular, pentagonal, hexagonal, or similar cross-sectional shape. The elongate susceptor elements may have a planar or flat cross-sectional area.

The susceptor elements may be solid, hollow, or porous. Preferably, each susceptor element is solid. Each susceptor element is preferably in the form of a pin, rod, blade, or plate. Each susceptor element preferably has a length of between 5 millimetres and 15 millimetres, for example between 6 millimetres and 12 millimetres, or between 8 millimetres and 10 millimetres. Each susceptor element preferably has a width of between 1 millimetres and 8 millimetres, more preferably from about 3 millimetres to about 5 millimetres. Each susceptor element may have a thickness of from about 0.01 millimetres to about 2 millimetres. If a susceptor element has a constant cross-section, for example a circular cross-section, it has a preferable width or diameter of between 1 millimetres and 5 millimetres.

The plurality of elongate susceptor elements may have substantially the same length. That is, the length of each elongate susceptor element may be within 10 percent, preferably 5 percent, of the lengths of the other elongate susceptor elements. The length of one or more of the plurality of elongate susceptor elements may differ from the lengths of the other elongate susceptor elements. The plurality of elongate susceptor elements may all have different lengths.

The plurality of elongate susceptor elements may have substantially the same width. That is, the width of each elongate susceptor element may be within 10 percent, preferably 5 percent, of the width of the other elongate susceptor elements. The width of one or more of the plurality of elongate susceptor elements may differ from the widths of the other elongate susceptor elements. The plurality of elongate susceptor elements may all have different widths.

The plurality of elongate susceptor elements may have substantially the same thickness. That is, the thickness of each elongate susceptor element may be within 10 percent, preferably 5 percent, of the thickness of the other elongate susceptor elements. The thickness of one or more of the plurality of elongate susceptor elements may differ from the thicknesses of the other elongate susceptor elements. The plurality of elongate susceptor elements may all have different thicknesses.

Preferably, the aerosol-generating device is portable. The aerosol-generating device may have a size comparable to a conventional cigar or cigarette. The aerosol-generating device may have a total length between approximately 30 millimetres and approximately 150 millimetres. The aerosol-generating device may have an external diameter between approximately 5 millimetres and approximately 30 millimetres.

The aerosol-generating device housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the chamber of the housing.

The aerosol-generating device may include a user interface to activate the aerosol-generating device, for example a button to initiate heating of the aerosol-generating device or display to indicate a state of the aerosol-generating device or of the aerosol-forming substrate.

The aerosol-generating device comprises a power supply. The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the aerosol-generating device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be a DC power supply. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts).

The power supply may be configured to operate at high frequency. As used herein, the term "high frequency oscillating current" means an oscillating current having a frequency of between 500 kilohertz and 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The aerosol-generating device comprises a controller connected to the inductor coil and the power supply. The controller is configured to control the supply of power to the inductor coil from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the inductor coil. Current may be supplied to one or both of the inductor coil continuously following activation of the aerosol-generating device or may be supplied intermittently, such as on a puff by puff basis. The electric circuitry may advantageously comprise DC/AC inverter, which may comprise a Class-D or Class-E power amplifier.

The plurality of elongate susceptor elements may be spaced apart from each other in a transverse direction of the chamber.

Due to the non-circular cross-sectional shape of the helical inductor coil, the fluctuating magnetic field is concentrated in a plurality of focus regions which are spaced apart in a transverse direction of the chamber. Each of the plurality of elongate susceptor elements may be at least partially aligned with one of the plurality of focus regions.

The elongate susceptor elements may be provided as part of the aerosol-generating device. The elongate susceptor elements may be attached to the housing of the aerosol-generating device such that they project into the chamber.

The plurality of elongate susceptor elements may be provided as part of the aerosol-generating article. Advantageously, by providing the plurality of elongate susceptor elements as part of the aerosol-generating article, the chamber of the aerosol-generation device may be substantially empty when no aerosol-generating article is received in the chamber. This may facilitate cleaning. The elongate susceptor elements may be in thermal proximity to the aerosol forming substrate. The elongate susceptor elements may be embedded in the aerosol-forming substrate. Form, kind, distribution and arrangement of the elongate susceptor elements may be selected according to a user's need. The elongate susceptor elements may be arranged substantially longitudinally within the aerosol-generating article. This means that the length dimension of the elongate susceptor elements may be arranged to be approximately parallel to the longitudinal direction of aerosol-generating article, for example within plus or minus 10 degrees of parallel to the longitudinal direction of the aerosol-generating article.

Where the elongate susceptor elements are provided as part of the aerosol-generating article, each elongate susceptor elements is preferably in the form of a pin, rod, blade, or plate. Each elongate susceptor element preferably has a length of between 5 millimetres and 15 millimetres, for example between 6 millimetres and 12 millimetres, or between 8 millimetres and 10 millimetres. Each susceptor element preferably has a width of between 1 millimetres and 8, for preferably from about 3 millimetres to about 5 millimetres. Each elongate susceptor element may have a thickness of between 0.01 millimetres and 2 millimetres, for example between 0.5 millimetres and 2 millimetres. If an elongate susceptor element has a constant cross-section, for example a circular cross-section, it has a preferable width or diameter of between 1 millimetre and 5 millimetres.

The elongate susceptor elements may be formed from any material that can be inductively heated to a temperature sufficient to generate an aerosol from the aerosol-forming substrate. Preferred susceptor elements comprise a metal or carbon. A suitable susceptor element may comprise a ferromagnetic material, for example ferritic iron, or a ferromagnetic steel or stainless steel. A suitable susceptor element may be, or comprise, aluminium. Preferred susceptor elements may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of each elongate susceptor element such as material type, length, width, and thickness may all be altered during manufacture to provide a desired power dissipation within a known electromagnetic field.

The aerosol-generating systems of the second and third aspects may be electrically operated smoking systems. The aerosol-generating system may be a handheld aerosol-generating system. The aerosol-generating system may have a size comparable to a conventional cigar or cigarette. The smoking system may have a total length between approximately 30 mm and approximately 150 mm. The smoking system may have an external diameter between approximately 5 mm and approximately 30 mm.

The aerosol-generating system is a combination of an aerosol-generating device and one or more aerosol-generating articles for use with the aerosol-generating device. However, aerosol-generating system may include additional components, such as, for example a charging unit for recharging an on-board electric power supply in an electrically operated or electric aerosol-generating device.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate comprises a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the chamber of the aerosol-generating device may be arranged such that the aerosol-generating article is partially received within the chamber of the aerosol-generating device. The chamber of the aerosol-generating device and the aerosol-generating article may be arranged such that the aerosol-generating article is entirely received within the chamber of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 mm. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug is approximately 7 millimetres in length in one embodiment, but may have a length of between approximately 5 millimetres to approximately 10 millimetres.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Features described in relation to one or more aspects may equally be applied to other aspects of the invention. In particular, features described in relation to the aerosol-generating device of the first aspect may be equally applied to the susceptor assembly of the second aspect, and to the aerosol-generating systems of the third and fourth aspects, and vice versa.

FIG. 1 shows a schematic cross-sectional illustration of an aerosol-generating system according to a first embodiment of the invention. The aerosol-generating system comprises an aerosol-generating device 100 according to a first embodiment and an aerosol-generating article 10 configured for use with the aerosol-generating device 100. FIGS. 2, 3, 4, 5 and 6 show different views of the aerosol-generating system.

The aerosol-forming article 10 includes an aerosol-forming segment 20 at its distal end. The aerosol-forming segment 20 contains an aerosol-forming substrate, for example a plug comprising tobacco material and an aerosol former, which is heatable to generate an aerosol.

The aerosol generating device 100 comprises a device housing 110 defining a chamber 120 for receiving the aerosol-generating article 10. The proximal end of the housing 110 has an insertion opening 125 through which the aerosol-generating article 10 may be inserted into and removed from the chamber 120. An inductor coil 130 is arranged inside the aerosol-generating device 100 between an outer wall of the housing 110 and the chamber 120. The inductor coil 130 is a helical inductor coil having a magnetic axis corresponding to the longitudinal axis of the chamber 120, which, in this embodiment, corresponds to the longitudinal axis of the aerosol-generating device 100. The inductor coil 130 is located adjacent to a distal portion of the chamber 120 and, in this embodiment, extends along part of the length of the chamber 120. In other embodiments, the inductor coil 130 may extend along all, or substantially all, of the length of the chamber 120, or may extend along part of the length of the chamber 120 and be located away from the distal portion of the chamber 120. For example, the inductor coil 130 may extend along part of the length of the chamber 120 and be adjacent to a proximal portion of the chamber 120. The inductor coil 130 is formed from a wire and has a plurality of turns, or windings, extending along its length. The wire may have any suitable cross-sectional shape, such as square, oval, or triangular. In this embodiment, the wire has a circular cross-section. In other embodiments, the wire may have a flat cross-sectional shape. For example, the inductor coil may be formed from a wire having a rectangular cross-sectional shape and wound such that the maximum width of the cross-section of the wire extends parallel to the magnetic axis of the inductor coil. Such flat inductor coils may allow the outer diameter of the inductor, and therefore the outer diameter of the aerosol-generating device, to be minimized.

The aerosol-generating device 100 also includes an internal electric power supply 140, for example a rechargeable battery, and a controller 150, for example a printed circuit board with circuitry, both located in a distal region of the housing 110. The controller 150 and the inductor coil 130 both receive power from the power supply 140 via electrical connections (not shown) extending through the housing 110. Preferably, the chamber 120 is isolated from the inductor coil 130 and the distal region of the housing 110, which contains the power source 140 and the controller 150, by a fluid-tight separation. Thus, electric components within the aerosol-generating device 100 may be kept separate from aerosol or residues produced within the chamber 120 by the aerosol generating process. This may also facilitate cleaning of the aerosol-generating device 100, since the chamber 120 may be made completely empty simply by removing the aerosol-generating article. This arrangement may also reduce the risk of damage to the aerosol-generating device, either during insertion of an aerosol-generating article or during cleaning, since no potentially fragile elements are exposed within the chamber 120. Ventilation holes (not shown) may be provided in the walls of the housing 110 to allow airflow into the chamber 120. Alternatively, or in addition, airflow may enter the chamber 120 at the opening 125 and flow along the length of the chamber 120 between the outer walls of the aerosol-generating article 10 and the inner walls of the chamber 120.

The aerosol-generating device 100 also includes a susceptor assembly 160 located within the chamber 120. The susceptor assembly 160 includes a base portion 170 and two elongate susceptor elements 180 attached to the base portion 170 and projecting into the chamber 120. The susceptor elements 180 are parallel with each other, with the longitudinal axis of the chamber 120, and with the magnetic axis of the inductor coil 130.

The susceptor elements 180 are spaced apart in a transverse direction and evenly spaced from the longitudinal axis of the chamber 120. The susceptor elements 180 are positioned within the portion of the chamber 120 which is surrounded by the inductor coil 130 so that they are inductively heatable by the inductor coil 130. Each susceptor element 180 is tapered towards its free end to form a sharp tip. This may facilitate insertion of the susceptor elements 180 into an aerosol-generating article received in the chamber. In this example, the base portion 170 is fixed within the chamber 120 and the susceptor elements 180 are fixed to the base portion 170. In other examples, the base portion 170 may be removably coupled to the housing 110 to allow the susceptor assembly 160 to be removed from the chamber 120 as a single component. For example, the base portion 170 may be removably coupled to the housing 110 using a releasable clip (not shown), a threaded connection, or similar mechanical coupling.

Figure 3:
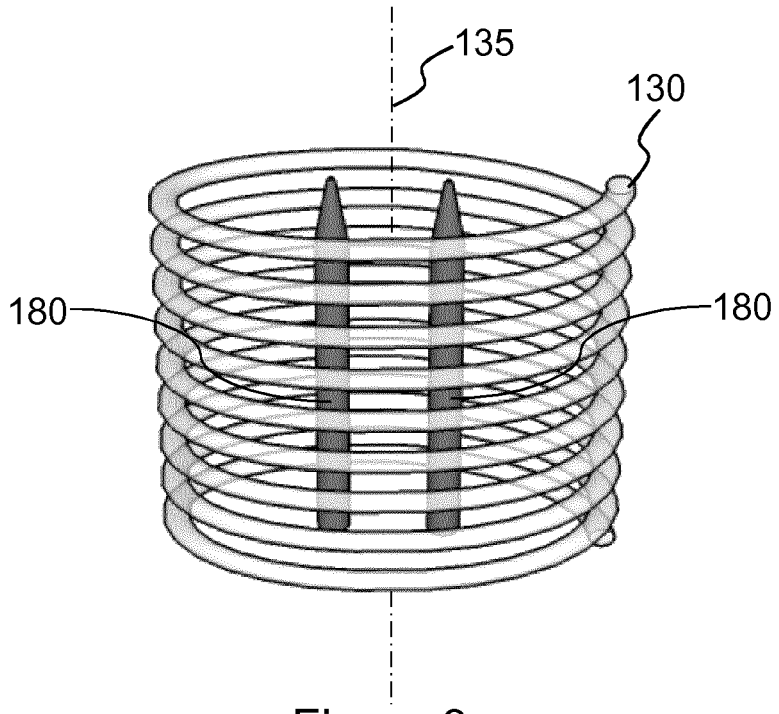
FIG. 3 is a perspective side view of the inductor coil and elongate susceptor elements of the aerosol-generating system of FIG. 1, with all other components omitted for clarity.
Figure 4:
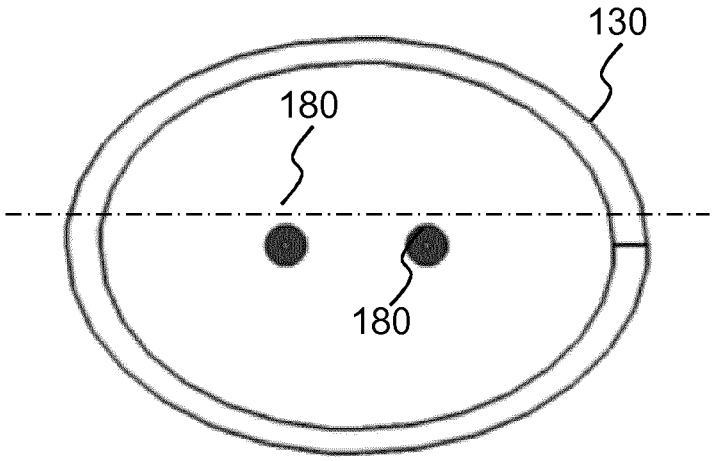
FIG. 4 is an end view of the inductor coil and elongate susceptor elements of FIG. 3.

As shown in FIG. 3 and FIG. 4, the inductor coil 130 has an elliptical cross-sectional shape. In this embodiment, the cross-sectional shape of the inductor coil 130 is substantially constant along its length. Thus, the inductor coil 130 has an elliptical cylindrical geometry. The elongate susceptor elements 180 are parallel to the magnetic axis 135 of the inductor coil 130. In this embodiment, the magnetic axis 135 of the inductor coil 130 is the same as the longitudinal axis of the inductor coil 130. In other embodiments, the magnetic axis 135 of the inductor coil 130 may be offset from the longitudinal axis of the inductor coil 130. The elongate susceptor elements 180 are each aligned with one of the focus points of the elliptical cross-sectional shape of the inductor coil 130 at any given point along the length of the elongate susceptor elements.

Figure 5:
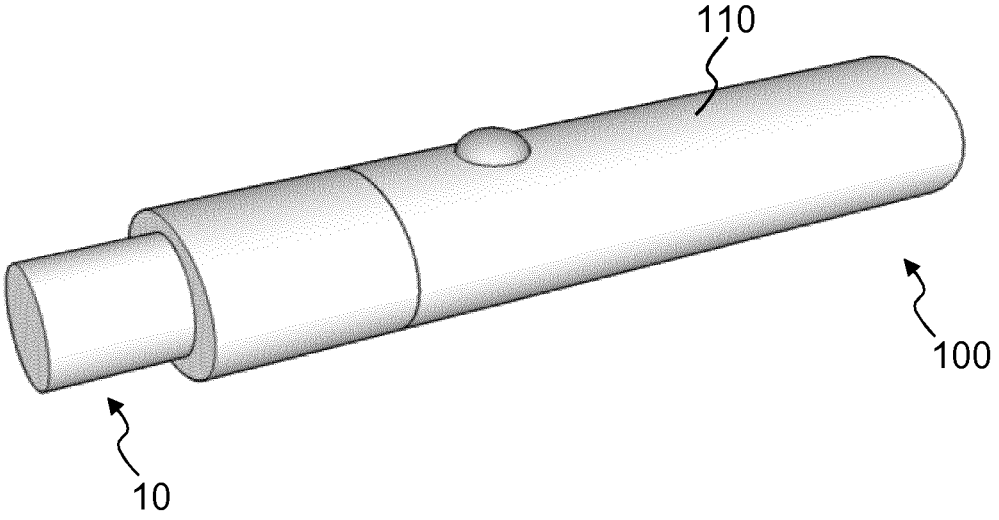
FIG. 5 is a perspective side view of the aerosol-generating system of FIG. 1.
Figure 6:
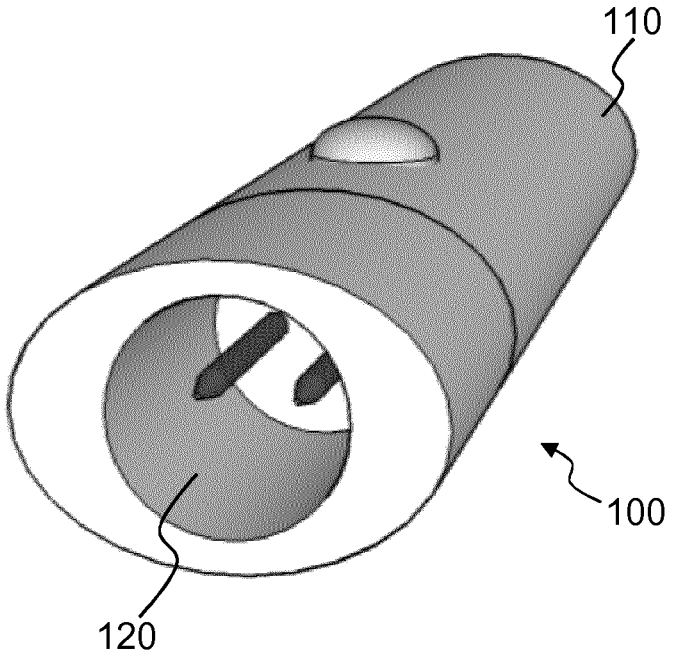
FIG. 6 is a perspective end view of the aerosol-generating system of FIG. 1.
Figure 7:
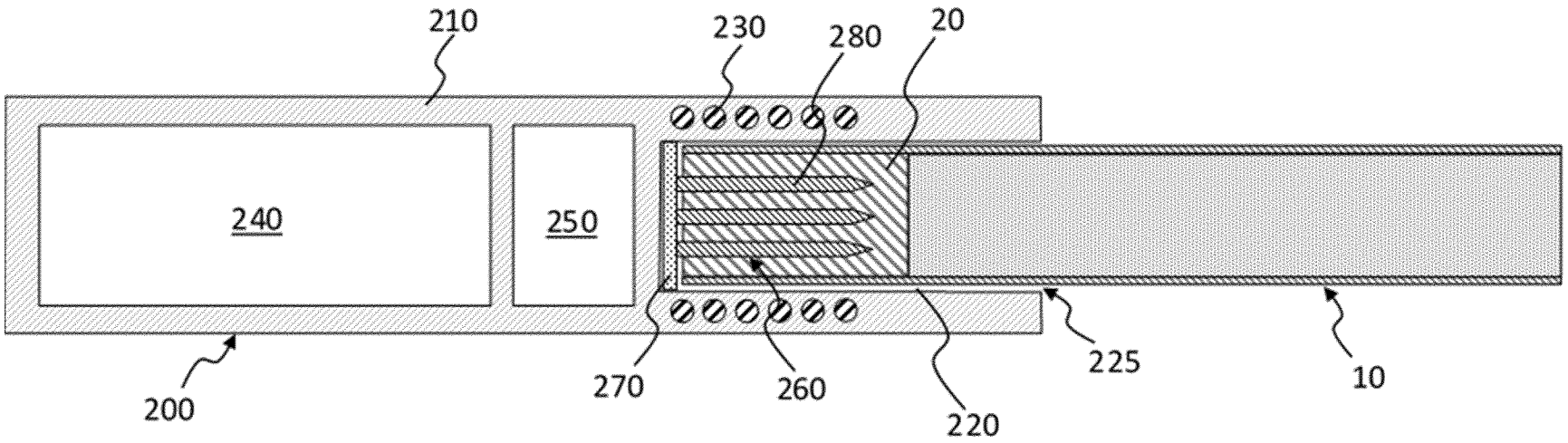
FIG. 7 is a schematic cross-sectional illustration of an aerosol-generating system in accordance with a second embodiment of the present invention.
Figure 8:
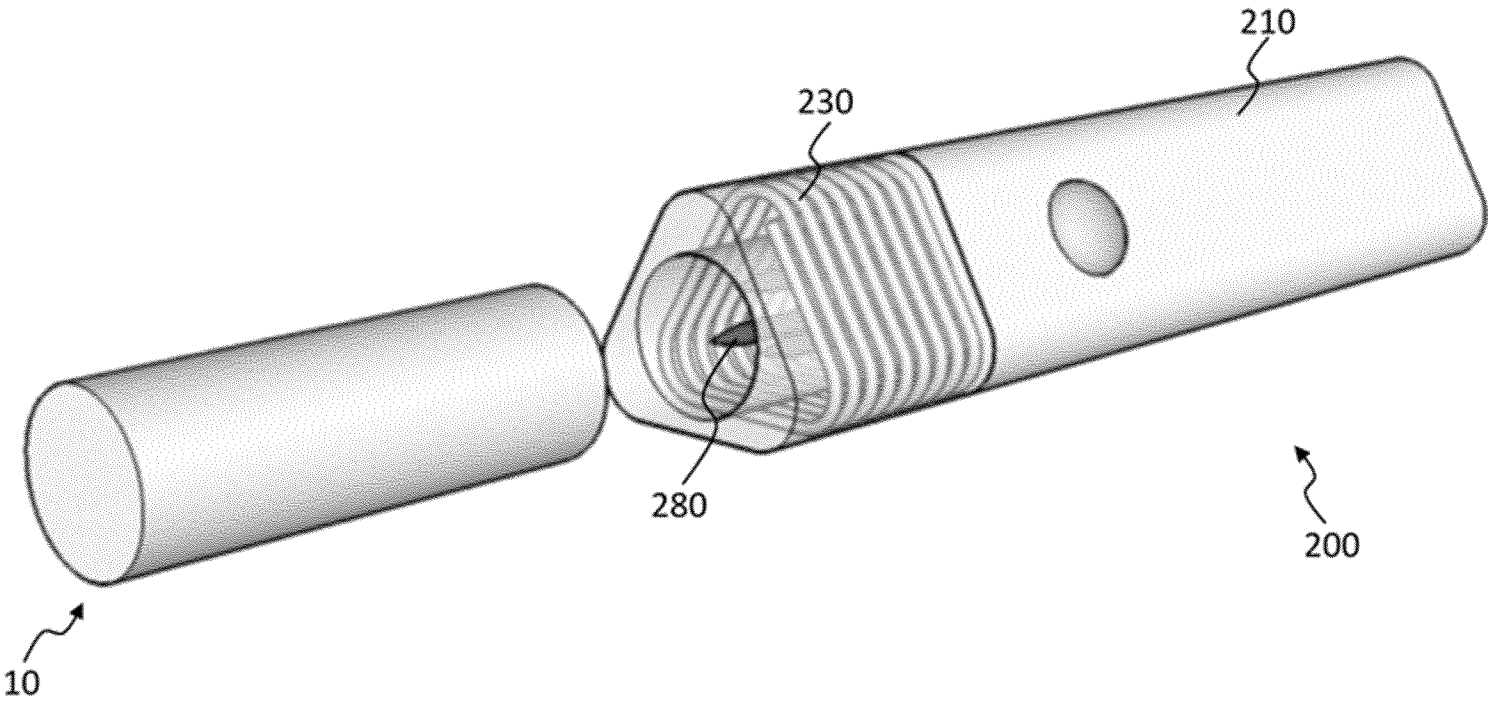
FIG. 8 is a perspective side view of the aerosol-generating system of FIG. 1, in which the aerosol-generating article is not received in the chamber and in which the inductor coil and the elongate susceptor elements are also shown.
Figure 9:
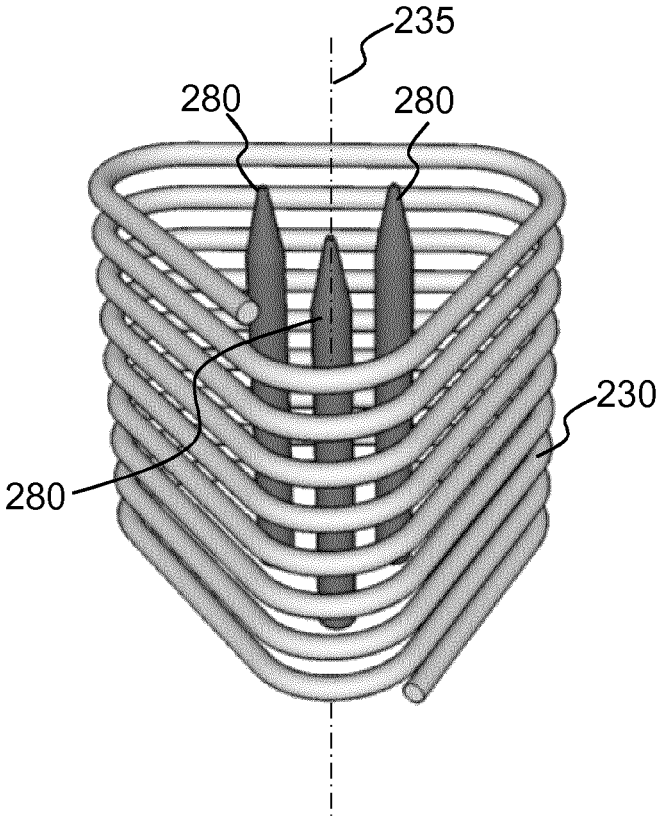
FIG. 9 is a perspective side view of the inductor coil and elongate susceptor elements of the aerosol-generating system of FIG. 7, with all other components omitted for clarity.
Figure 10:
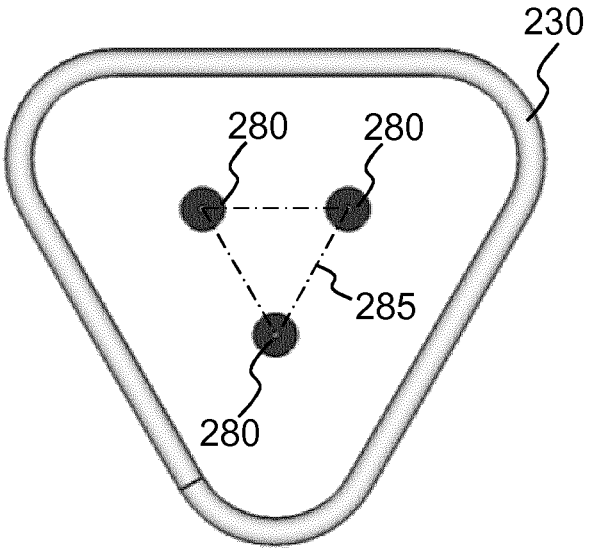
FIG. 10 is an end view of the inductor coil and elongate susceptor elements of FIG. 9.
Figure 11:
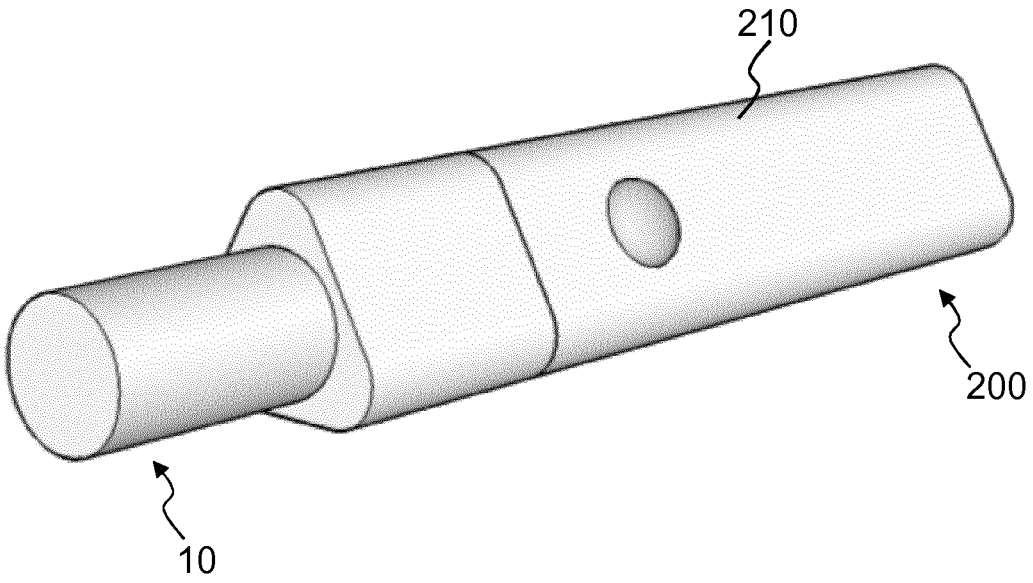
FIG. 11 is a perspective side view of the aerosol-generating system of FIG. 1.
Figure 12:
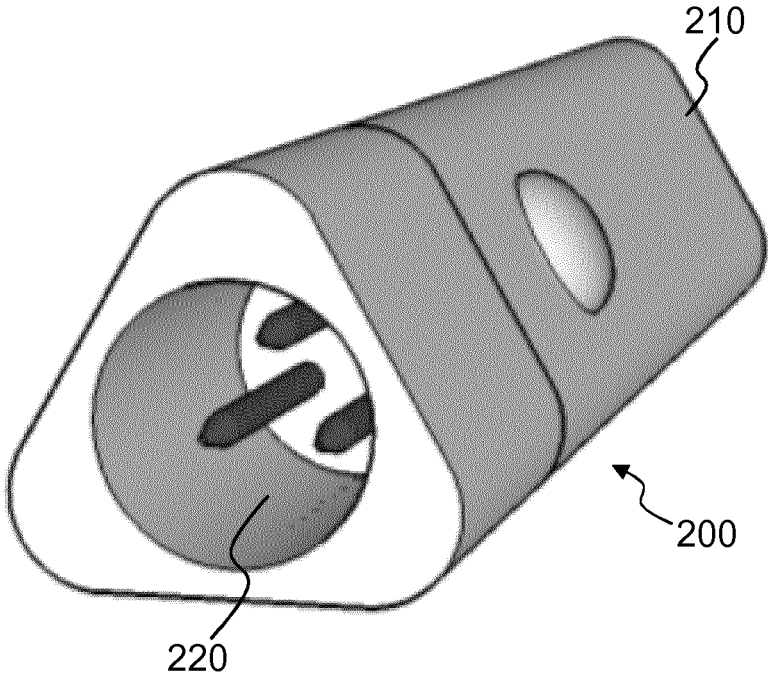
FIG. 12 is a perspective end view of the aerosol-generating system of FIG. 1.

As shown in FIG. 5 and FIG. 6, the housing 110 of the aerosol-generating device 100 has an elliptical cross-sectional shape corresponding to the elliptical cross-sectional shape of the inductor coil. Arranging the cross-sectional shape of the housing 110 to correspond to the cross-sectional shape of the inductor coil facilitates a compact arrangement. It may also prevent the aerosol-generating device 100 from rolling when placed on a sloping surface. The chamber 120 has a circular cross-sectional shape to correspond with the circular cylindrical shape of the aerosol-generating article 10.

When the aerosol-generating device 100 is actuated, a high-frequency alternating current is passed through the inductor coil 130 to generate an alternating magnetic field within the distal portion of the chamber 120 of the aerosol-generating device 100. The magnetic field is concentrated in two focus regions across the cross-section of the inductor coil 130. These two focus regions correspond to the positions of the elongate susceptor elements 180 along the length of the inductor coil 130. In this manner, the elongate susceptor elements are each aligned with one of the two focus regions. The magnetic field preferably fluctuates with a frequency of between 1 and 30 MHz, preferably between 2 and 10 MHz, for example between 5 and 7 MHz. When an aerosol-generating article 10 is correctly located in the chamber 120, the susceptor elements 180 are located within the aerosol-forming substrate 20 of the aerosol-generating article. The fluctuating field generates eddy currents within the susceptor elements 180, which are heated as a result. Further heating is provided by magnetic hysteresis losses within the susceptor elements 180. The heated susceptor elements 180 heat the aerosol-forming substrate 20 of the aerosol-generating article 10 to a sufficient temperature to form an aerosol. The aerosol may then be drawn downstream through the aerosol-generating article 10 for inhalation by the user. Such actuation may be manually operated or may occur automatically in response to a user drawing on the aerosol-generating article 10, for example by using a puff sensor.

The aerosol-generating device may further comprise a flux concentrator (not shown) positioned around the inductor coil 130 and formed from a material having a high relative magnetic permeability so that the magnetic field produced by the inductor coil 130 is attracted to and guided by the flux concentrator. In this manner, the flux concentrator may limit the extent to which the magnetic field produced by the inductor coil 130 extends beyond the housing 110 and may increase the density of the magnetic field within the chamber 120. This may increase the current generated within the susceptor elements to allow for more efficient heating. Such a flux concentrator may be made from any suitable material or materials having a high relative magnetic permeability. For example, the flux concentrator may be formed from one or more ferromagnetic materials, for example a ferrite material, a ferrite powder held in a binder, or any other suitable material including ferrite material such as ferritic iron, ferromagnetic steel or stainless steel. The flux concentrator is preferably made from a material or materials having a high relative magnetic permeability. That is, a material having a relative magnetic permeability of at least 5 when measured at 25 degrees Celsius, for example, at least 10, at least 20, at least 30, at least 40, at least 50, at least 60, at least 80, or at least 100. These example values may refer to the relative magnetic permeability of the flux concentrator material for a frequency of between 6 and 8 MHz and a temperature of 25 degrees Celsius.

FIGS. 7 to 12 illustrate an aerosol-generating system according to a second embodiment of the invention. The aerosol-generating system comprises an aerosol-generating device 200 according to a second embodiment and an aerosol-generating article 10 configured for use with the aerosol-generating device 200.

The aerosol-generating device 200 of the second embodiment is similar in construction and operation to the aerosol-generating device 100 of the first embodiment and where the same features are present, like reference numerals have been used. However, unlike the aerosol-generating device 100 of the first embodiment, the inductor coil 230 of the aerosol-generating device 200 has a triangular cross-sectional sectional shape and the inductor assembly 260 comprises three elongate susceptor elements 280 attached to the base portion 270. The triangular cross-sectional shape of the inductor coil 230 is an equilateral triangle with rounded vertices. The three susceptor elements 280 are arranged in a regular pattern. In particular, the susceptor elements 280 are arranged such that each susceptor element 280 is positioned at the vertex of an equilateral triangle 285 within the triangular cross-sectional shape defined by the inductor coil 230. In this manner, the plurality of elongate susceptor elements 280 are spaced apart both in a first transverse direction of the chamber and in a second traverse direction of the chamber which is perpendicular the first transverse direction. This means that the plurality of elongate susceptor elements 280 are spaced apart across the area of the chamber 220 and each extend along a different plane. This may facilitate even heating of the aerosol-forming substrate of an aerosol-generating article received in the chamber.

The housing 210 of the aerosol-generating device 200 has a triangular cross-sectional shape corresponding to the triangular cross-sectional shape of the inductor coil 230.

Arranging the cross-sectional shape of the housing 210 to correspond to the cross-sectional shape of the inductor coil 230 facilitates a compact arrangement. It may also prevent the aerosol-generating device 200 from rolling when placed on a sloping surface. The chamber 230 has a circular cross-sectional shape to correspond with the circular cylindrical shape of the aerosol-generating article 10.

When the aerosol-generating device 200 is actuated, a high-frequency alternating current is passed through the inductor coil 230 to generate an alternating magnetic field within the distal portion of the chamber 220 of the aerosol-generating device 100. The magnetic field is concentrated in three focus regions across the cross-section of the inductor coil 230. These three focus regions correspond to the positions of the elongate susceptor elements 280 along the length of the inductor coil 230. In this manner, the elongate susceptor elements are each aligned with one of the three focus regions. The magnetic field preferably fluctuates with a frequency of between 1 and 30 MHz, preferably between 2 and 10 MHz, for example between 5 and 7 MHz. When an aerosol-generating article 10 is correctly located in the chamber 220, the susceptor elements 280 are located within the aerosol-forming substrate 20 of the aerosol-generating article. The fluctuating field generates eddy currents within the susceptor elements 280, which are heated as a result. Further heating is provided by magnetic hysteresis losses within the susceptor elements 280. The heated susceptor elements 280 heat the aerosol-forming substrate 20 of the aerosol-generating article 10 to a sufficient temperature to form an aerosol. The aerosol may then be drawn downstream through the aerosol-generating article 10 for inhalation by the user. Such actuation may be manually operated or may occur automatically in response to a user drawing on the aerosol-generating article 10, for example by using a puff sensor.

Figure 13:
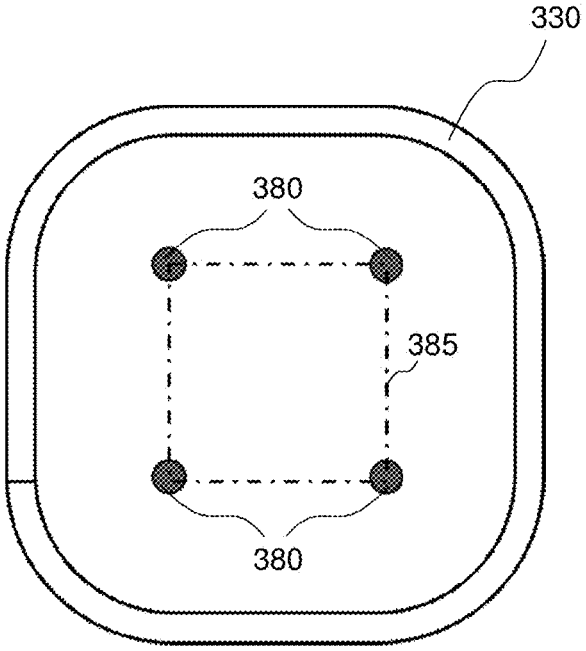
FIG. 13 is an end view of a square inductor coil and four elongate susceptor elements in accordance with another embodiment of the present invention.

FIG. 13 is an end view of a square inductor coil 330 and four elongate susceptor elements 380 in accordance with another embodiment of the invention. The inductor coil 330 has a square cross-sectional shape. The four susceptor elements 380 are arranged in a square 385 within the square cross-sectional shape of the inductor coil 330. Each of the four susceptor elements 380 is disposed at a different corner of the square such that it is at least partially aligned with one of a plurality of focus regions.

The exemplary embodiments described above are not intended to limit the scope of the claims. Other embodiments consistent with the exemplary embodiments described above will be apparent to those skilled in the art.

The invention claimed is:

1. An aerosol-generating device, comprising:

a housing having a chamber configured to receive at least a portion of an aerosol-generating article;

an inductor coil disposed around at least a portion of the chamber;

a plurality of elongate susceptor elements projecting into the chamber and spaced apart from each other, the plurality of elongate susceptor elements each extending substantially parallel to a magnetic axis of the inductor coil; and a power supply and a controller connected to the inductor coil and configured to provide an alternating electric current to the inductor coil such that the inductor coil generates an alternating magnetic field to heat the plurality of elongate susceptor elements and thereby heat at least a portion of the aerosol-generating article received in the chamber, wherein the inductor coil is helical and has a non-circular cross-sectional shape so that the inductor coil is configured to concentrate the alternating magnetic field in a plurality of focus regions, and wherein each of the plurality of elongate susceptor elements is at least partially aligned with one of the plurality of focus regions.

2. The aerosol-generating device according to claim 1, wherein the plurality of elongate susceptor elements are substantially parallel with a longitudinal direction of the chamber.

3. The aerosol-generating device according to claim 1, wherein the plurality of elongate susceptor elements are each spaced apart from a longitudinal axis of the chamber.

4. The aerosol-generating device according to claim 1, wherein the plurality of elongate susceptor elements are equidistant from the longitudinal axis of the chamber.

5. The aerosol-generating device according to claim 1, wherein the plurality of elongate susceptor elements comprises three or more elongate susceptor elements that are spaced apart in a first transverse direction of the chamber and in a second traverse direction of the chamber, which is perpendicular to the first transverse direction.

6. The aerosol-generating device according to claim 5, wherein each of the three or more elongate susceptor elements is disposed at a vertex of a regular polygon within the non-circular cross-sectional shape of the inductor coil.

7. The aerosol-generating device according to claim 1, wherein the inductor coil has a triangular cross-sectional shape, wherein the plurality of elongate susceptor elements comprises three elongate susceptor elements arranged in a triangle within and corresponding to the triangular cross-sectional shape of the inductor coil, and wherein each of the three elongate susceptor elements is disposed at a different vertex of the triangle and is at least partially aligned with one of the plurality of focus regions.

8. The aerosol-generating device according to claim 1, wherein the inductor coil has a square cross-sectional shape, wherein plurality of elongate susceptor elements comprises four elongate susceptor elements arranged in a square within and corresponding to the square cross-sectional shape of the inductor coil, and wherein each of the four elongate susceptor elements is disposed at a different corner of the square and is at least partially aligned with one of the plurality of focus regions.

9. The aerosol-generating device according to claim 1, wherein the inductor coil has an elliptical cross-sectional shape, and wherein the plurality of elongate susceptor elements comprises two elongate susceptor elements each of which is at least partially aligned with one of the plurality of focus regions.

10. The aerosol-generating device according to claim 9, wherein each of the two elongate susceptor elements is disposed at a focus of the elliptical cross-sectional shape.

11. The aerosol-generating device according to claim 1, wherein each of the plurality of elongate susceptor elements comprises a tapered free end.

12. The aerosol-generating device according to claim 11, wherein the plurality of elongate susceptor elements are removably attached to the housing.

13. An aerosol-generating system, comprising:

an aerosol-generating device according to claim 1; and an aerosol-generating article having an aerosol-forming substrate and being configured for use with the aerosol-generating device.

14. An aerosol-generating system, comprising:

an aerosol-generating device and an aerosol-generating article having an aerosol-forming substrate and being configured for use with the aerosol-generating device, wherein the aerosol-generating device comprises:

a housing having a chamber configured to receive at least a portion of the aerosol-generating article, an inductor coil disposed around at least a portion of the chamber, and a power supply and a controller connected to the inductor coil; and a plurality of elongate susceptor elements disposed in the chamber and spaced apart from each other, the plurality of elongate susceptor elements each extending substantially parallel to a magnetic axis of the inductor coil, wherein the power supply and the controller are configured to provide an alternating electric current to the inductor coil such that the inductor coil generates an alternating magnetic field to heat the plurality of elongate susceptor elements and thereby heat at least a portion of the aerosol-generating article, wherein the inductor coil is helical and has a non-circular cross-sectional shape so that the inductor coil is configured to concentrate the alternating magnetic field in a plurality of focus regions, and wherein each of the plurality of elongate susceptor elements is at least partially aligned with one of the plurality of focus regions.

15. The aerosol-generating system according to claim 14, wherein the plurality of elongate susceptor elements are provided as part of the aerosol-generating article.

* * * * *